US006588058B2

(12) United States Patent
Vanderlinden

(10) Patent No.: US 6,588,058 B2
(45) Date of Patent: Jul. 8, 2003

(54) LARGE AREA SURFACE CLEANING TOOL

(76) Inventor: Roger P. Vanderlinden, 73 Sherman Ave. S., Hamilton (CA), L8M 2P8

( * ) Notice: Subject to any disclaimer, the term of this patent is extended or adjusted under 35 U.S.C. 154(b) by 0 days.

(21) Appl. No.: 09/811,775

(22) Filed: Mar. 20, 2001

(65) Prior Publication Data

US 2002/0133902 A1 Sep. 26, 2002

(51) Int. Cl.[7] ..... A47L 9/02
(52) U.S. Cl. ..... 15/416; 15/419
(58) Field of Search ..... 15/416, 417, 418, 15/419, 421

(56) References Cited

U.S. PATENT DOCUMENTS 1,026,104 A * 5/1912 Moorhead ..... 15/417
1,740,001 A * 12/1929 Carlstedt ..... 15/416
1,782,882 A * 11/1930 Rippey ..... 15/416
1,860,854 A * 5/1932 Engberg et al. ..... 15/416
2,117,329 A * 5/1938 Eriksson-Jons ..... 15/417
2,143,845 A * 1/1939 Edstrom ..... 15/417
2,190,679 A * 2/1940 Replogle ..... 15/417
2,239,384 A * 4/1941 Hansson ..... 15/417
2,502,612 A * 4/1950 Woock ..... 15/421
2,624,064 A * 1/1953 Snyder ..... 15/417
3,750,222 A * 8/1973 Johnson ..... 15/416
3,949,442 A * 4/1976 Chandler ..... 15/415.1
4,395,794 A * 8/1983 Duncan ..... 15/340.1
4,458,378 A * 7/1984 Helmes ..... 15/401
4,573,236 A * 3/1986 Dyson ..... 15/333
4,723,338 A * 2/1988 Otsubo ..... 15/416
4,776,059 A * 10/1988 Worwag ..... 15/331
4,864,681 A * 9/1989 Hult et al. ..... 15/367
4,888,852 A * 12/1989 Varin ..... 15/373
5,123,141 A * 6/1992 Erickson et al. ..... 15/373
5,553,349 A * 9/1996 Kilstrom et al. ..... 15/360
5,839,157 A * 11/1998 Strauser et al. ..... 15/418
5,839,161 A * 11/1998 Liang ..... 15/393
5,970,577 A * 10/1999 Kim ..... 15/398
6,039,817 A * 3/2000 Payne ..... 134/21
6,122,798 A * 9/2000 Kobayashi et al. ..... 15/386
6,125,500 A * 10/2000 Kat ..... 15/344

* cited by examiner

*Primary Examiner*—Theresa T. Snider

(57) ABSTRACT

A large area surface cleaning tool, for suctioning both dust and debris from a surface being cleaned, has a housing having a surface facing peripheral bottom edge defining a suctioning bottom opening. An elongate wand has an inlet disposed in suctioning relation with the suctioning bottom opening of the housing and connected in fluid communication via an airflow passageway to an outlet disposed exteriorly to the housing and in fluid communication and in debris transfer relation to a vacuum source. A first debris duct operatively mounted on one of the housing and the elongate wand for movement therewith and having a debris inlet disposed in suctioning relation exteriorly to the housing at least partially above the peripheral bottom edge of the housing to thereby accent debris too large to pass between the peripheral bottom edge and a surface being cleaned during use, and connected in fluid communication to a debris outlet disposed in debris transfer relation to the vacuum source.

28 Claims, 16 Drawing Sheets

LARGE AREA SURFACE CLEANING TOOL

FIELD OF THE INVENTION

The present invention relates to large area surface cleaning tools, and more particularly relates to large area surface cleaning tools for suctioning both dust and debris from a surface.

BACKGROUND OF THE INVENTION

It is well known that vacuum cleaners employ various types of cleaning tools or attachments each specifically designed to clean a particular type, shape or size of surface. For instance, large area surface cleaning tools are designed specifically for cleaning large surface areas, such as floors, and the like. Such large area surface cleaning tools include a housing with a suctioning bottom opening having a large cross-sectional area, with the bottom opening being defined by a perimeter wall. The bottom edge of the perimeter wall may be flat or may be ridged, or may comprise downwardly extending brush bristles or rubber squeegees in the case of wet vacuum tools. In any case, in use, the bottom edge of the peripheral wall remains generally in close proximity to the floor in order to maintain a suctioning force sufficient enough to urge dust on the surface being cleaned into the interior of the housing of the large area surface cleaning tool.

An elongate wand is either permanently or removably connected in suctioning relation to the housing, which elongate wand has an internal passageway having a significantly smaller cross-sectional area than the large cross-sectional area of the bottom opening of the large area surface cleaning tool.

There are several inter-related design factors to be considered in the design of a vacuum cleaner and the specific tools that are used with it, such as large area surface cleaning tools. In general, vacuum cleaners and their tools are designed to pick up dust, debris, litter, and so on, quickly and powerfully, in order to maximize vacuuming effectiveness, including minimizing the time spent vacuuming.

In order to maximize vacuuming effectiveness, the airflow (measured in volume of air per unit time) and the suction (typically measured by the height of a column of water that can be raised) generated by the suctioning unit must be optimized. However, it is well known that suctioning units that have high air flow tend to have less than ideal suction capability, and suctioning units that have high suction tend to have less than ideal air flow. Accordingly, even for powerful industrial type vacuum cleaners, the practical limits for air flow and suction are easily reached. Therefore, the cleaning capability of a vacuum cleaner's tools is correspondingly limited. Moreover, fine particulate filters that are incorporated into many modern vacuum cleaners can filter only so much air per unit time, thus providing yet another barrier to maximizing the effectiveness of a vacuum cleaner by merely increasing the airflow and suction.

In the specific case of large area surface cleaning tools, it is well known they should be as wide as possible in order to permit vacuuming of an area as quickly as possible. Further, due to the above discussed air flow and suction limitations, they should be quite narrow in depth from front to back in order to minimize the cross-sectional area of the suctioning bottom opening. Even with a narrow as practical depth from front to back, large area surface cleaning tools have a maximum width of about two feet.

Another necessary consideration is that there is also a maximum overall space between the tool and the floor in order to maintain sufficient airflow and suctioning into the interior of the tool. If this maximum overall space is exceeded, the airflow and suction will be too low to cause effective cleaning. Accordingly, many surface cleaning tools are made to suction only fine debris, such as dust and other fine particulate matter.

However, when using such a large area surface cleaning tool to vacuum a large generally flat surface such as a floor, it is common to encounter small pieces of debris, especially when cleaning shop floors and in industrial situations such as warehouse floors. These small pieces of debris are too large to pass between the bottom edge of a surface cleaning tool and the surface being cleaned, even though the debris may be small enough to be suctioned up by the vacuum cleaner, and are merely pushed around the surface by the large area surface cleaning tool. In order to suction these larger pieces of debris, the large area surface cleaning tool must be lifted up off the surface and then be accurately set down directly onto the debris and the bottom edge of the peripheral wall of the housing must again come into close proximity with the surface being cleaned in order to establish sufficient airflow to urge the debris into the inlet end of the elongate wand. This method is highly undesirable, especially in industrial situations, where the large area surface cleaning tools are heavy. Also, such lifting of a large area surface cleaning tool must typically be done with two hands, even though generally pushing it around can be accomplished with one hand.

Alternatively, some floor tools have small gaps between their bottom edge and the surface being cleaned, which gaps permit the suctioning of small debris, such as sawdust and small woodchips and the like, but not larger debris. However, such gaps are included at the sacrifice of width of the tool by virtue of compromised vacuum and air flow to the outer ends of the tool. Still, it is necessary to lift up the tool and set it back down in order to pick up large debris.

Furthermore, large area surface cleaning tools often have another significant drawback. They may be too narrow from front to back to suction debris between the front and back portions of the perimeter wall. This relationship is even narrower in the case of wet vacuum tools. In this case, the suctioning hose that connects to the wand can be separated from the elongate wand and the user can bend down and suction up debris directly with the hose. However, this is also highly undesirable since it is labour intensive and time consuming.

It is an object of the present invention to provide a large area surface cleaning tool that permits suctioning of both dust and debris from a surface without having to pick up the head and set it down onto debris.

It is another object of the present invention to provide a large area surface cleaning tool that permits suctioning of both dust and debris from a surface while manipulating the tool with one hand.

It is a further object of the present invention to provide a large area surface cleaning tool that permits suctioning of both dust and debris from a surface without separating the tool from a suctioning hose.

It is still a further object of the present invention to provide a large area surface cleaning tool that permits suctioning of both dust and debris from a surface with increased effectiveness and efficiency.

It is yet another object of the present intention to provide a large area surface cleaning tool wherein debris is not suctioned through the suctioning bottom opening of the housing of the large area surface cleaning tool.

SUMMARY OF THE INVENTION

In accordance with one aspect of the present invention, there is disclosed a novel floor cleaning apparatus for suctioning both dust and debris from a surface being cleaned. The floor cleaning apparatus comprises a housing having a surface facing peripheral bottom edge defining a bottom plane, and having a suctioning bottom opening surrounded by the peripheral bottom edge. In use, the suctioning bottom opening is in dust suctioning relation to the surface being cleaned when the surface facing peripheral bottom edge is adjacent the surface being cleaned. An elongate wand has an inlet disposed in dust and debris suctioning relation with respect to the suctioning bottom opening, and connected in fluid communication via an airflow passageway to an outlet disposed in dust and debris transfer relation with a vacuum source. A debris pick-up duct has a debris inlet situated adjacent to and at least partially above the bottom plane and exteriorly to the peripheral bottom edge of the housing, and a debris outlet in debris transfer relation with the vacuum source. A valve means is mounted for operative engagement with the debris pick-up duct for movement between a dust suctioning configuration whereat substantially all of the airflow to the vacuum source passes through the suctioning bottom opening of the housing and a debris suctioning configuration whereat substantially all of the airflow to the vacuum source passes through the debris pick-up duct. In use, the debris inlet is in debris receiving relation with respect to the surface being cleaned when the surface facing peripheral bottom edge of the housing is adjacent the surface being cleaned.

In accordance with another aspect of the present invention, there is disclosed a novel floor cleaning apparatus for suctioning both dust and debris from a surface being cleaned. The floor cleaning apparatus comprises a housing having a surface facing peripheral bottom edge defining a bottom plane, and having a suctioning bottom opening surrounded by the peripheral bottom edge. In use, the suctioning bottom opening is in dust suctioning relation to the surface being cleaned when the surface facing peripheral bottom edge is adjacent the surface being cleaned. An elongate wand has an inlet disposed in dust and debris suctioning relation with respect to the suctioning bottom opening and connected in fluid communication via an airflow passageway to an outlet in dust and debris transfer relation with a vacuum source. A debris pick-up duct has a debris inlet situated adjacent to and at least partially above the bottom plane and exteriorly to the peripheral bottom edge of the housing, and a debris outlet in debris transfer relation with the vacuum source. A valve means is mounted for operative engagement with the debris pick-up duct for movement between a dust suctioning configuration whereat the majority of the airflow to the vacuum source passes through the suctioning bottom opening of the housing and a debris suctioning configuration whereat more airflow to the vacuum source passes through the debris pick-up duct than in the dust suctioning configuration, and wherein the valve means is biased to the dust suctioning configuration. In user the debris inlet is in debris receiving relation with respect to the surface being cleaned when the surface facing peripheral bottom edge of the housing is adjacent the surface being cleaned.

In accordance with another aspect of the present invention, there is disclosed a novel floor cleaning apparatus for suctioning both dust and debris from a surface being cleaned. The floor cleaning apparatus comprises a housing having a surface facing peripheral bottom edge defining a bottom plane, and having a suctioning bottom opening surrounded by the peripheral bottom edge. In use, the suctioning bottom opening is in dust suctioning relation to the surface being cleaned when the surface facing peripheral bottom edge is adjacent the surface being cleaned. An elongate wand has an inlet disposed in dust and debris suctioning relation with respect to the suctioning bottom opening and connected via an airflow passageway having a general cross-sectional area to an outlet disposed in dust and debris transfer relation with a vacuum source. A debris pick-up duct has a debris inlet situated adjacent to and at least partially above the bottom plane and exteriorly to the peripheral bottom edge of the housing, and a debris outlet in debris transfer relation with the vacuum source. The debris inlet has a cross-sectional area greater than one-third of the general cross-sectional area of the elongate wand. In use, the debris inlet is in debris receiving relation with respect to the surface being cleaned when the surface facing peripheral bottom edge of the housing is adjacent the surface being cleaned.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described hereinbelow.

BRIEF DESCRIPTION OF THE DRAWINGS

The novel features which are believed to be characteristic of the large area surface cleaning tool according to the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only, and are not intended as a definition of the limits of the invention. In the accompanying drawings.

DETAILED DESCRIPTION OF A PREFERRED EMBODIMENT

Figure 1A:
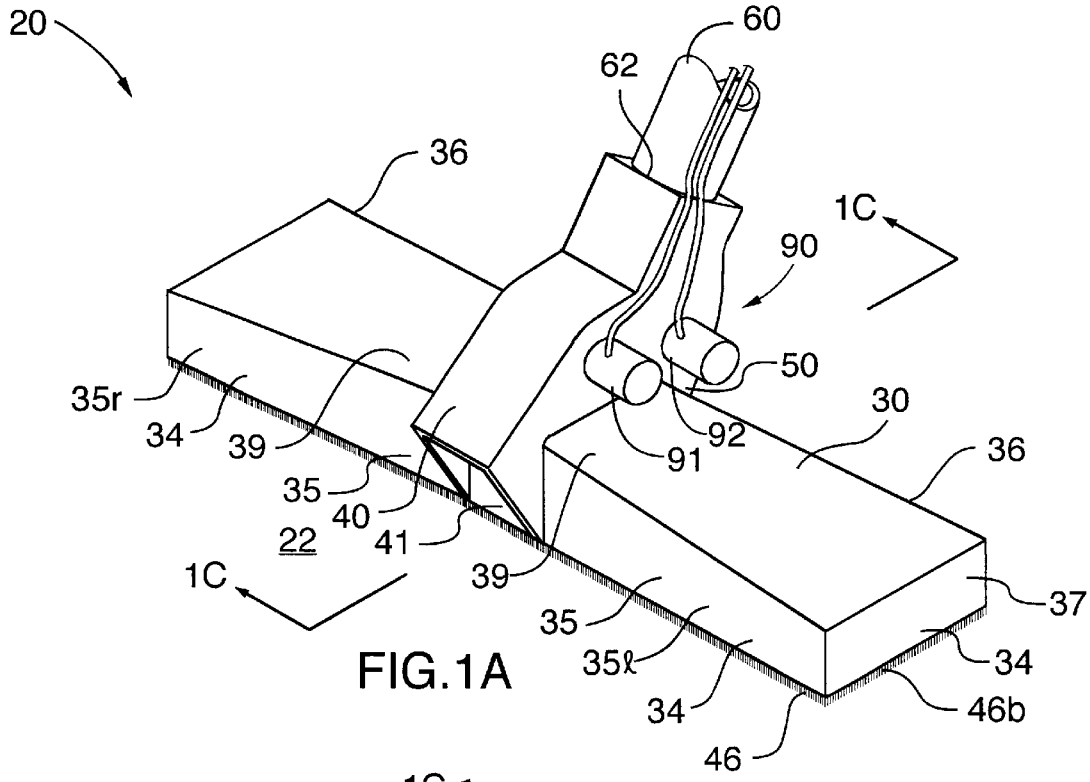
FIG. 1A is a perspective view of a first preferred embodiment of the large area surface cleaning tool according to the present invention.
Figure 1B:
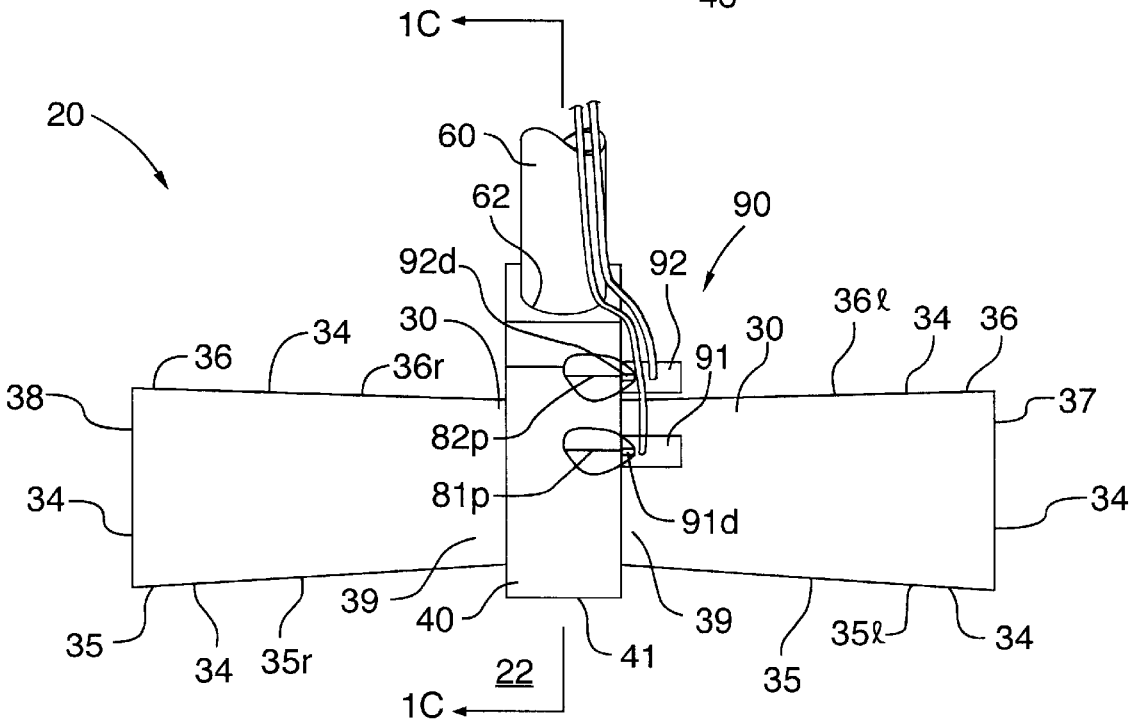
FIG. 1B is a top plan view of the first preferred embodiment large area surface cleaning tool of FIG. 1A.

Referring to FIGS. 1A through 5D of the drawings, it will be noted that FIGS. 1A through 1F illustrate the first preferred embodiment of the large area surface cleaning tool of the present invention, FIGS. 2A through 2D illustrate the second preferred embodiment of the large area surface cleaning tool of the present invention, FIGS. 3A through 3D illustrate the third preferred embodiment of the large area surface cleaning tool of the present invention, FIGS. 4A through 4D illustrate the fourth preferred embodiment of the large area surface cleaning tool of the present invention; and FIGS. 5A through 5D illustrate the fifth preferred embodiment of the large area surface cleaning tool of the present invention.

Reference will now be made to FIGS. 1A through 1F, which show a first preferred embodiment of the floor cleaning apparatus of the present invention, as indicated by general reference numeral 20. The floor cleaning apparatus 20, which is also known as a large area surface cleaning tool 20, is for suctioning both dust and debris from a surface 22 being cleaned, such as a factory floor, or any other substantially flat surface.

Briefly, the large area surface cleaning tool 20 comprises a housing 30 having a surface facing peripheral bottom edge 46 that defines a suctioning bottom opening 48. A main duct 60 has an inlet 62 disposed in suctioning relation with said suctioning bottom opening 48 of the housing 30 and connected in fluid communication via an internal airflow passageway 64 to an outlet 66 disposed exteriorly to the housing 30 and operatively connected in fluid communication and in debris transfer relation to a vacuum source 69. A first debris pick-up duct 40 has a debris inlet 41 and a debris outlet 42. Similarly, a second debris pick-up duct 50 has a debris inlet 51 and a debris outlet 52. A valve means 50 is provided for controlling air and debris flow through the first debris pick-up duct 40. A selectively operable control means 90 is provided for controlling the valve means 80.

The various elements of large area surface cleaning tool 20 will now be described in greater detail.

The large area surface cleaning tool 20 comprises a housing 30 that has a perimeter portion 34 that terminates downwardly in the surface facing peripheral bottom edge 46 defining a bottom plane, and has a front portion 35, a back portion 36, a left end portion 37, and a right end portion 38. As can be best seen in FIGS. 1A, the housing 30 is elongate from its left end portion 37 to its right end portion 38, and is preferably about one to two feet long (from the left end portion 37 to the right end portion 38), about two inches high, and about two inches from front to back. The front portion 35 of the perimeter portion 34 comprises left and right portions 35*l*, 35*r* that are each sloped rearwardly and inwardly to the debris inlet 41 of the first debris pick-up duct 40. Similarly, the back portion 36 of the perimeter portion 34 comprises left and right portions 36*l*, 36*r* that are each sloped forwardly and inwardly to the debris inlet 51 of the second debris duct 50.

The housing 30 is also tapered downwardly from a raised central portion 39 towards each of the left and right end portions 37,38, and is also tapered slightly from front to back towards each of the left and right end portions 37,38. In this manner, the left and right end portions 37,38 can be used to vacuum into narrow passageways or corridors, and the like, such as under the bottom of shelving racks or between adjacent shelving racks.

Figure 1C:
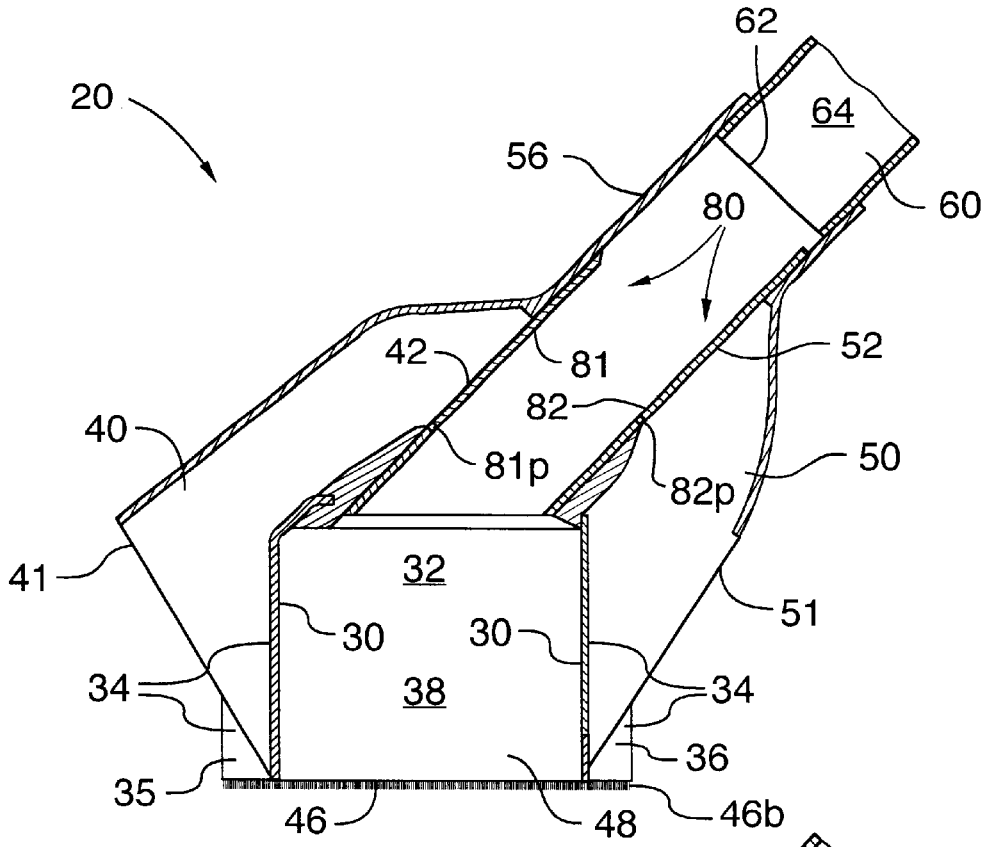
FIG. 1C is a cross-sectional side elevational view of the first preferred embodiment large area surface cleaning tool of FIG. 1A taken along section line 1C—1C, with both flap valves in a closed position.
Figure 1D:
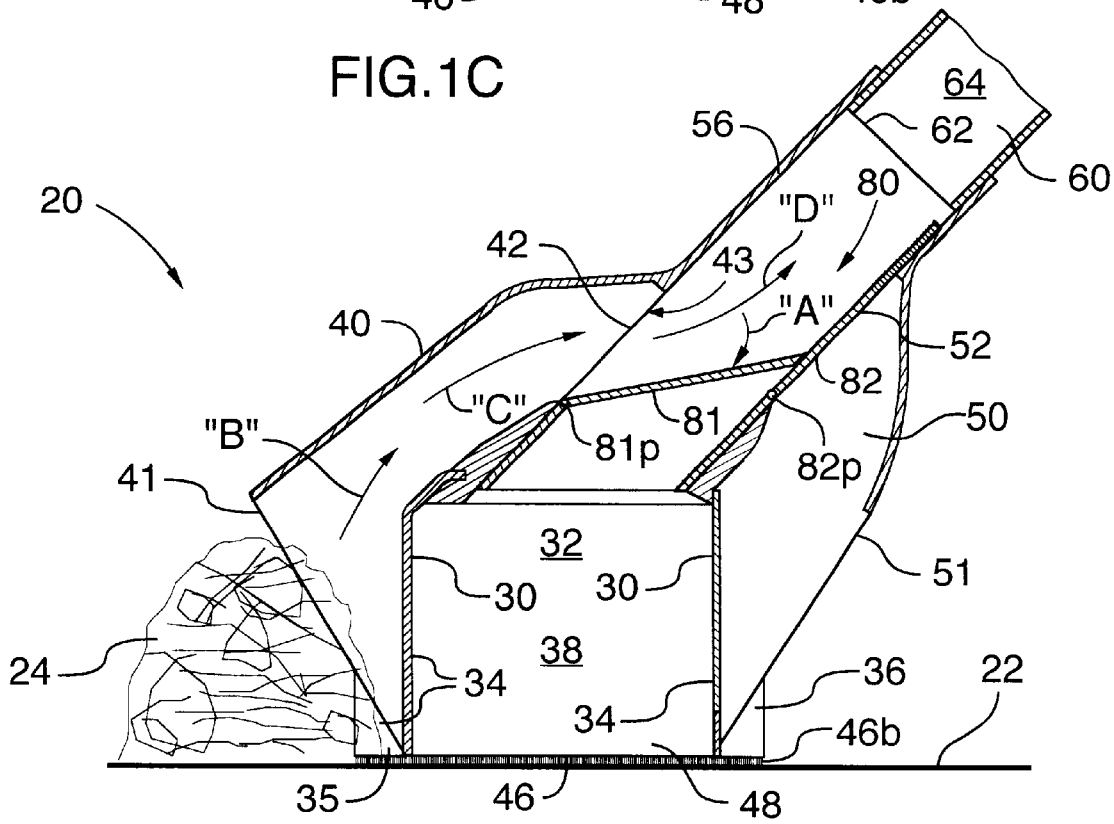
FIG. 1D is a cross-sectional side elevational view similar to FIG. 1C, but with the first flap valve in an open position, and with debris entering into the first debris pick-up duct.
Figure 1E:
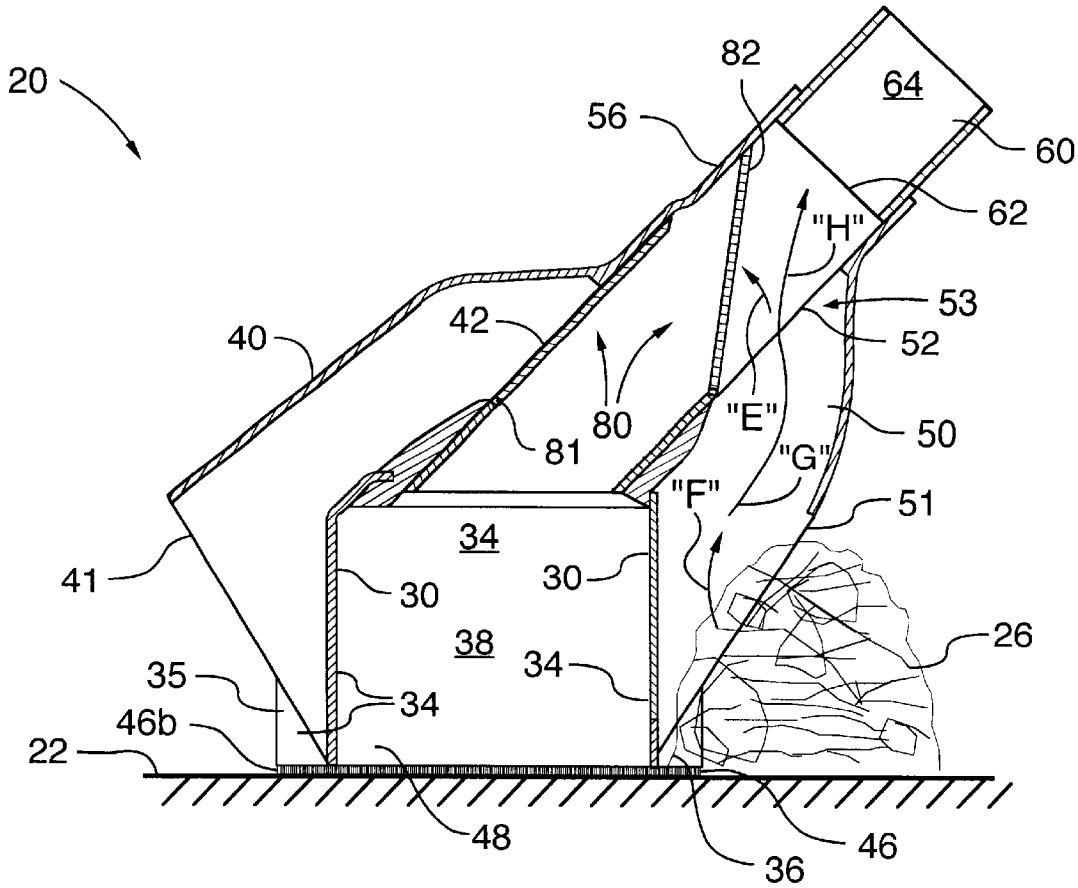
FIG. 1E is a cross-sectional side elevational view similar to FIG. 1C, but with the second flap valve in an open position, and with debris entering into the first debris pick-up duct.

The housing 30 of the large area surface cleaning tool 20 has a substantially hollow interior 32, as can best be seen in FIGS. 1C through 1E. The surface facing peripheral bottom edge 46 surrounds and defines the suctioning bottom opening 48 that is continuous with the interior 32 of the housing 30. In use, typically at least a portion of the surface facing peripheral bottom edge 46 is in contact with the surface 22 being cleaned, in order to maintain the housing 30 in dust suctioning relation with respect to the surface 22 being cleaned when the surface facing peripheral bottom edge is adjacent the surface being cleaned. In this manner, air and dust can enter the interior 32 of the housing 30, thus maintaining dust suctioning relation with respect to the surface 22 being cleaned. It is also possible that the housing 30 could be supported on wheels such that the surface facing peripheral bottom edge 46 does not quite contact the surface 22 being cleaned, but is disposed in very closely spaced relation thereto, thus maintaining its dust suctioning relation with respect to the surface 22 being cleaned.

The surface facing peripheral bottom edge 46 preferably comprises numerous downwardly projecting bristles 46*b* that permit the housing 30 of the large area surface cleaning tool 20 to slide along a smooth floor without doing damage to either the floor or the surface facing peripheral bottom edge 46 of the housing 30. The bristles also provide an airflow passageway between the surface 22 being cleaned and the remainder of the housing 30, which airflow passageway has a relatively small cross-sectional area, that is preferably less than or even approximately the same cross-sectional area as the internal airflow passageway of the elongate wand 60, so as to permit a suitable high speed airflow between the surface 22 being cleaned and the remainder of the housing 30, and subsequently into the housing 30 through the suctioning bottom opening 48.

Figure 1F:
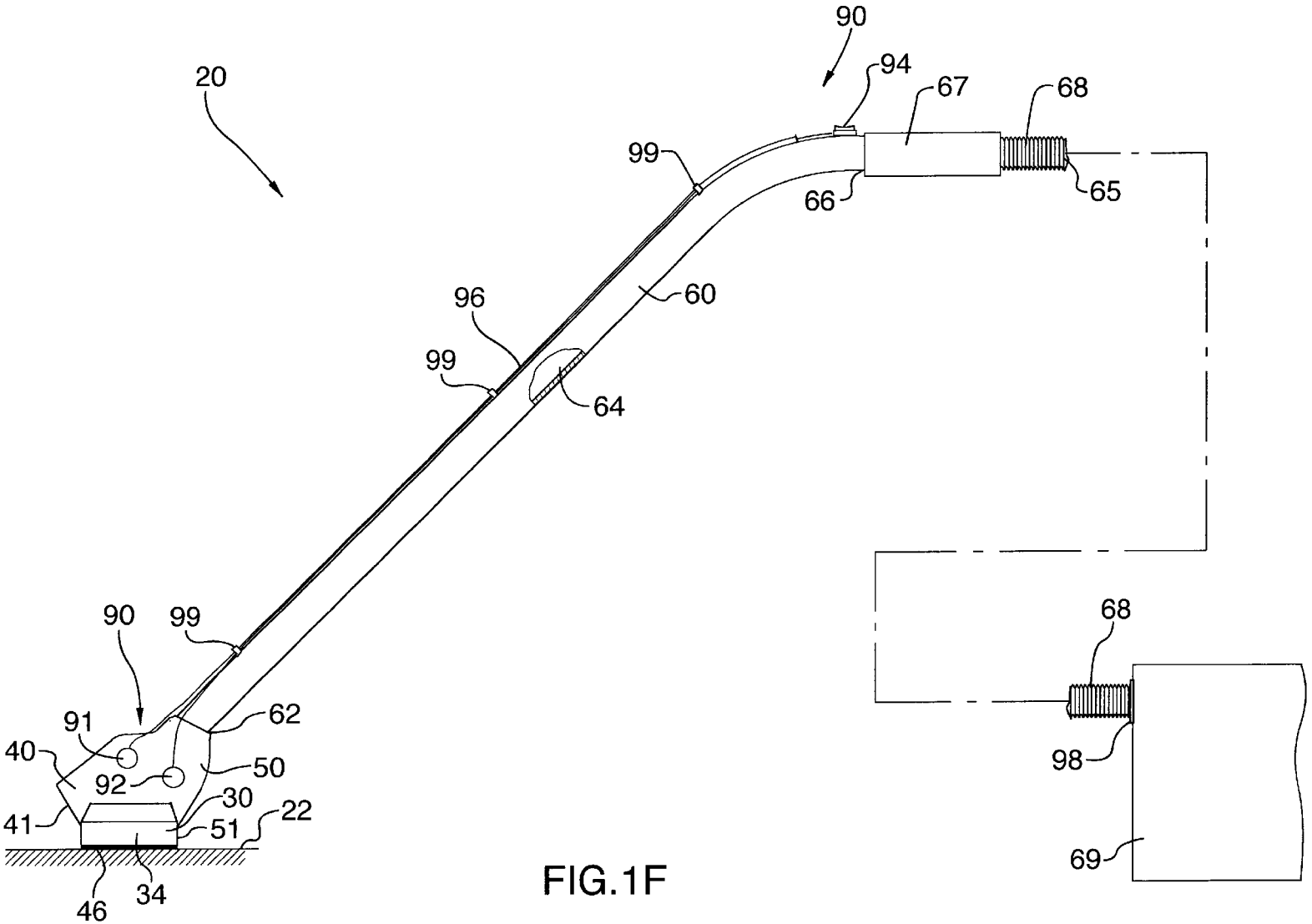
FIG. 1F is a reduced scale side elevational view of the first preferred embodiment large area surface cleaning tool of FIG. 1A.

As is best seen in FIG. 1F, the elongate wand 60 is connected at its inlet 62 to a crown portion 56 of the housing 30 and is connected at its outlet 66 to a handle portion 67 that joins the outlet 66 to the flexible suction hose 68 that is in turn connected to the vacuum source 69 by a connector 98. The inlet 62 is connected via an airflow passageway 64 having a general cross-sectional area, to the outlet 66. Preferably, the elongate wand 60 is made from a rigid metal material, such as stainless steel or any other suitable metal or metals, as is well known in the industry. In the above described manner, the elongate wand 60 is interposed between the housing 30 and the flexible suction hose 68 that also has an airflow passageway 65 and that is connected in fluid communication and debris depositing relation to the vacuum source 69. The vacuum source 69 comprises both a source of vacuum and a debris receptacle, as is well known in the art. The elongate wand 60 permits manual manipulation of the large area surface cleaning tool 20. The elongate wand 60 has an inlet 62 disposed in suctioning relation with the suctioning bottom opening 48 of the housing 30, as can be best seen in FIGS. 1C through 1E. The elongate wand 60 is connected in fluid communication via an internal airflow passageway 64 to an outlet 66 disposed exteriorly to the housing 30 and operatively connected in fluid communication with and in dust and debris transfer relation to the vacuum source 69. The inlet 62 is thereby operatively connected in fluid communication with and in dust and debris transfer relation to the vacuum source 69, to thereby permit access by dust and debris through the elongate wand 60 and into the vacuum source 69.

The first debris pick-up duct 40 is operatively mounted on the housing 30 for movement therewith, as the housing 30 is moved across the surface 22 being cleaned. In the first preferred embodiment as illustrated, the first debris pick-up duct 40 is integrally formed with the housing 30. Alternatively, the first debris pick-up duct 40 may be operatively mounted on the elongate wand 60 so as to extend downwardly therefrom.

The debris inlet 41 of the first debris pick-up duct 40 is disposed forwardly of the housing 30 between the left and right portions 35*l*, 35*r* of the front portion 35 of the perimeter portion 34 of the housing 30, in suctioning relation exteriorly to the housing 30. Also, the debris inlet 41 of the first debris pick-up duct 10 is situated adjacent to and disposed at least partially above the bottom plane at the peripheral bottom edge of the housing 30, and exteriorly to the peripheral bottom edge 46 of the housing 30 to thereby accept debris too large to pass between the peripheral bottom edge and a surface 22 being cleaned, during use, as can be seen in FIGS. 1C through 1E, and as can be best seen in FIG. 1D. The debris inlet 41 of the first debris pick-up duct 40 is also connected in fluid communication to a debris outlet 42 disposed in dust and debris transfer relation to the vacuum source 69, through the elongate wand 60 and the flexible suction hose 68. More particularly, in the first preferred embodiment, the debris outlet 42 of the first debris pick-up duct 40 is disposed in debris transfer relation and in fluid communication at an airflow junction 43 with the airflow passageway 64 of the elongate wand 60. As can be seen in the figures, the debris inlet 41 has a cross-sectional area greater than one-third of the general cross-sectional area of the elongate wand 60. Preferably, the debris inlet 41 has a cross-sectional area greater than one-half of the general cross-sectional area of the elongate wand 60.

In the first preferred embodiment, as illustrated, the valve means 80, is mounted for operative engagement with the debris pick-up duct 40 for movement between a dust suctioning configuration, as can be best seen in FIGS. 1C and 1E, and a debris suctioning configuration, as can be best seen in FIG. 1D. In the dust suctioning configuration, substantially all of the airflow to the vacuum source 69 passes through the suctioning bottom opening 48 of the housing 30. It would also be acceptable if the first flap valve 81 did not close all of the way, such that just the majority of the airflow to the vacuum source 69 passes through the suctioning bottom opening 48 of the housing 30. In the debris suctioning configuration, substantially all of the airflow to the vacuum source 69 passes through the debris pick-up duct 40. It would also be acceptable if the first flap valve 81 did not close all of the way, such that some airflow to the vacuum source 69 passes through the suctioning bottom opening 48 of the housing 30. Preferably, in the debris suctioning configuration, more airflow that goes to the vacuum source 69 passes through the debris pick-up duct 40 than in the dust suctioning configuration. The valve means 80 for controlling air and debris flow through the first debris pick-up duct 40 comprises a diverter valve, and more specifically a first flap valve 81, as can be best seen in FIGS. 1C through 1E. The first flap valve 81 is pivotally movable between a debris blocking position, as can be best seen in FIGS. 1C and 1E, and which is equivalent to the dust suctioning configuration, and a debris passage position, as can be best seen in FIG. 1D, and which is equivalent to the debris suctioning configuration, which pivotal movement is indicated by arrow "A". In the debris blocking position, the debris outlet 42 of first debris pick-up duct 40 is closed off from being in debris transfer relation to the vacuum source 69, through the elongate wand 60 and the flexible suction hose 68. In the debris passage position, the debris outlet 42 of first debris pick-up duct 40 is disposed in debris transfer relation and in fluid communication with the airflow passageway of the elongate wand 60 and with the vacuum source 69. Accordingly, debris 24 is suctioned into the debris inlet 41 of the first debris pick-up duct 40, as indicated by arrow "B" in FIG. 1D, through the first debris pick-up duct 40, as indicated by arrow "C", into the inlet 62 of the elongate wand 60, as indicated by arrow "D", and through the airflow passageway 64 of the elongate wand 60 to the vacuum source 69.

The large area surface cleaning tool 20 further comprises a second debris duct 50 operatively mounted on the housing 30, and in the first preferred embodiment as illustrated, the second debris duct 50 is integrally formed with the housing 30. Alternatively, the second debris duct 50 may be operatively mounted on the elongate wand 60 so as to extend downwardly therefrom.

The second debris duct 50 has debris inlet 51 disposed rearwardly of the housing 30 between the left and right portions 36*l*, 36*r* of the back portion 36 of the housing 30, in suctioning relation exteriorly to the housing 30. Also, the inlet 51 of the second debris duct 50 is disposed at least partially above the peripheral bottom edge of the housing 30, to thereby accept debris too large to pass between the peripheral bottom edge and a surface 22 being cleaned, during use, as can be seen in FIGS. 1C through 1E, and as can be best seen in FIG. 1E. The debris inlet 51 of the second debris duct 50 is also connected in fluid communication to debris outlet 52 disposed in debris transfer relation to the vacuum source 69, through the elongate wand 60 and the flexible suction hose 68. Morel particularly, in the first preferred embodiment, the debris outlet 52 of the second debris duct 50 is disposed in debris transfer relation and in fluid communication at an airflow junction 53 with the airflow passageway 64 of the elongate wand 60.

In the first preferred embodiment, as illustrated, the valve means 80 for controlling air and debris flow through the first debris duct 40 also comprises another diverter valve, and more specifically a second flap valve 82, as can be best seen in FIGS. 1C through 1E. The second flap valve 82 is movable between a debris blocking position, as can be best seen in FIGS. 1C and 1D, and a debris passage position, as can be best seen in FIG. 1E and as indicated by arrow "E". In the debris blocking position, the debris outlet 52 of second debris duct 50 is closed off from being in debris transfer relation to the vacuum source 69, through the elongate wand 60 and the flexible suction hose 68. In the debris passage position, the debris outlet 52 of second debris duct 50 is disposed in debris transfer relation and in fluid communication with the airflow passageway 64 of the elongate wand 60 and the vacuum source 69. Accordingly, debris 26 is suctioned into the debris inlet 51 of the second debris duct 50, as indicated by arrow "F" in FIG. 1E, through the second debris duct 50, as indicated by arrow "G", into the inlet 62 of the elongate wand 60, as indicated by arrow "H", and through the airflow passageway 64 of the elongate wand 60 to the vacuum source 69.

As can be seen in FIGS. 1D and 1E, it is preferable to have only one of the first and second flap valves 81,82 in the debris passage position at a time in order to provide sufficient suction to the respective one of the first and second debris inlets 41, 51.

It is contemplated that it is also possible to have the first and second flap valves 81,82 not completely close off the inlet 62 of the elongate wand 60 from fluid communication with the interior 38 of the housing 30. In this manner, at least a partial air flow is maintained at all times so as to maintain suctioning of dust through the housing 30 at all times. However, in this instance, full suction would not be available to either of the first and second debris pick-up ducts 40,50.

The selectively operable means 90 for controlling the valve means 80, or in other words the first flap valve 81 and the second flap valve 82, from their respective dust suctioning positions to their respective debris suctioning positions, comprises a first electrically operated rotary solenoid 91 and a second electrically operated rotary solenoid 92, respectively. As can be best seen in FIGS. 1A and 1B, the body of each of the first and second solenoids 91,92 is securely mounted to the first and second debris ducts 40,50, respectively, by means of suitable threaded fasteners (not shown). The rotating drive shaft 91*d*, 92*d* of each of the first and second solenoids 91,92 is directly connected to the pivot axle 81*p*,82*p* of the respective one of the first and second flap valves 81,82.

The selectively operable control means 90 for controlling the valve means 80 also comprises a thumb operable momentary contact single-pole double-throw rocker switch 94 mounted onto the elongate wand 60 adjacent the handle portion 67, and electrically connected to the solenoid by a wire 96 secured to the elongate wand 60 by a plurality of "U"-shaped connectors 99 threadibly fastened to the elongate wand 60.

Reference will now be made to FIGS. 2A through 2D, which show a second preferred embodiment of the large area surface cleaning tool of the present invention, as indicated by general reference numeral 220. The large area surface cleaning tool 220 is similar to the first preferred embodiment large area surface cleaning tool 20, except that there is only a first debris pick-up duct 240 and a first flap valve 281. The first flap valve 281 is mounted onto the first debris pick-up duct 240 adjacent, yet slightly above, the inlet 241 for pivotal movement between a debris blocking position, as can be best seen in FIG. 2B, and a debris passage position, as can be best seen in FIG. 2C, which pivotal movement is indicated by arrow "I", the first flap valve 81 is biased to its dust suctioning configuration by spring 282, as can be best seen in FIG. 28. In a manner similar to the first preferred embodiment, debris 224 is suctioned into the debris inlet 241 of the first debris pick-up duct 240, as indicated by arrow "J" in FIG. 2C, through the first debris pick-up duct 240, as indicated by arrow "K", into the inlet 262 of the elongate wand 260, as indicated by arrow "L", and through the airflow passageway 264 of the elongate wand 260 to the vacuum source 269. The vacuum source 269 comprises both a source of vacuum and a debris receptacle, as is well known in the art.

Further, the selectively operable control means 290 comprises a manually operable cable 291 disposed within a sheath 292 and secured at its lower end 291*a* to the first flap valve 281. The cable 291 passes through an aperture 294 in a tab 295 projecting outwardly from the first flap valve 281. A securing member 296 is crimped onto the lower end 291*a* of the cable 291 as it loops back onto itself.

Figure 2A:
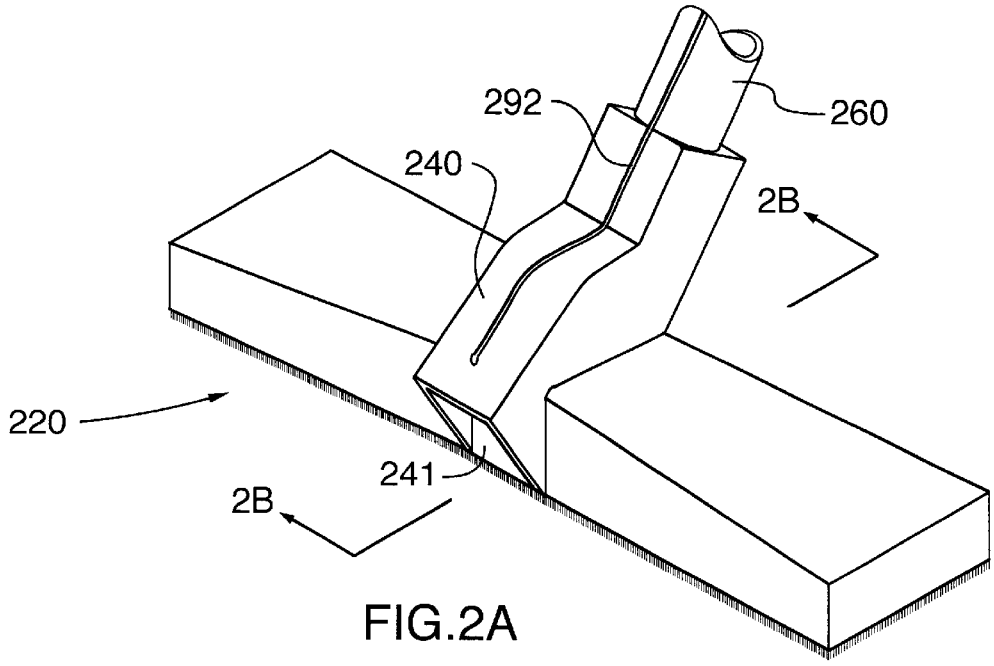
FIG. 2A is a perspective view of a second preferred embodiment of the large area surface cleaning tool according to the present invention.
Figure 2B:
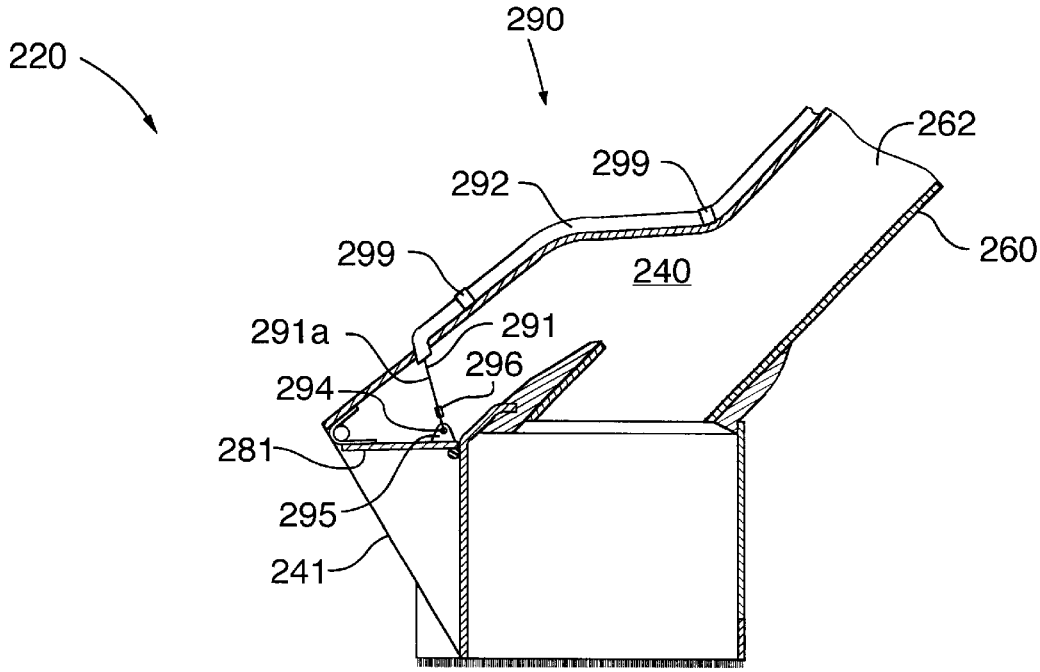
FIG. 2B is a cross-sectional side elevational view of the second preferred embodiment large area surface cleaning tool of FIG. 2A, taken along section line 2B—2B, with the flap valve in a closed position.
Figure 2C:
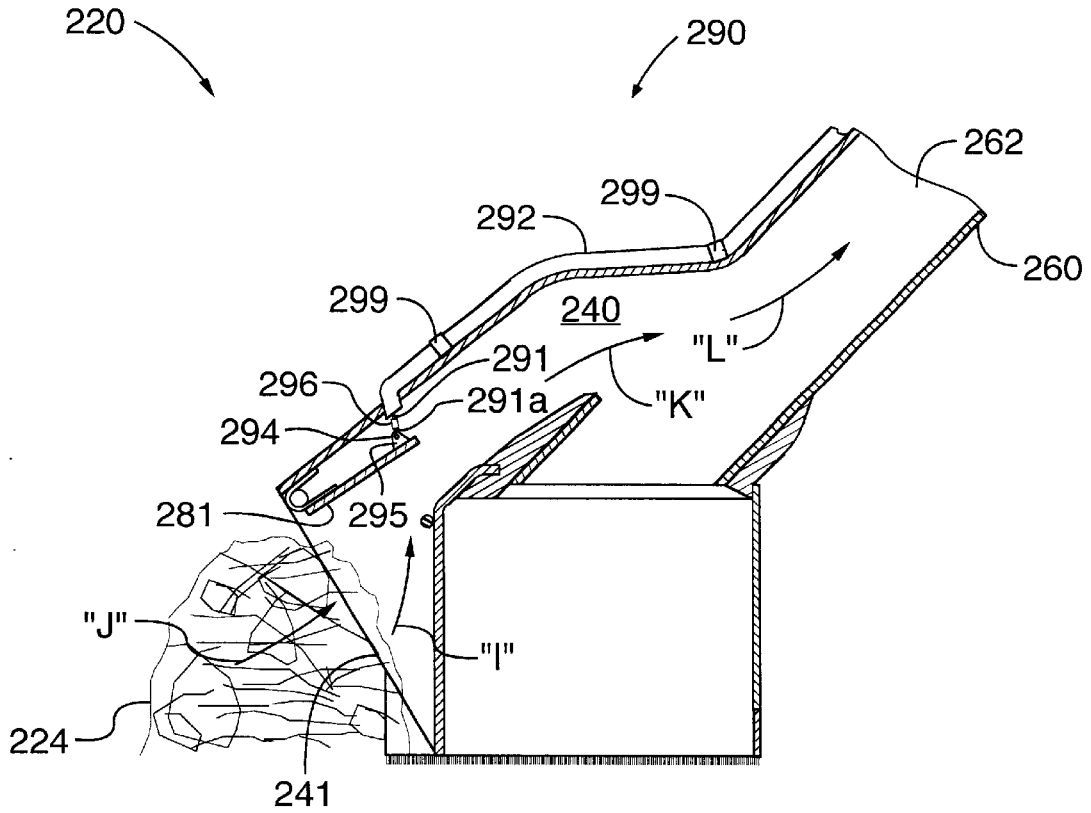
FIG. 2C is a cross-sectional side elevational view similar to FIG. 2B, but with the flap valve in an open position, and with debris entering into the first debris pick-up duct.
Figure 2D:
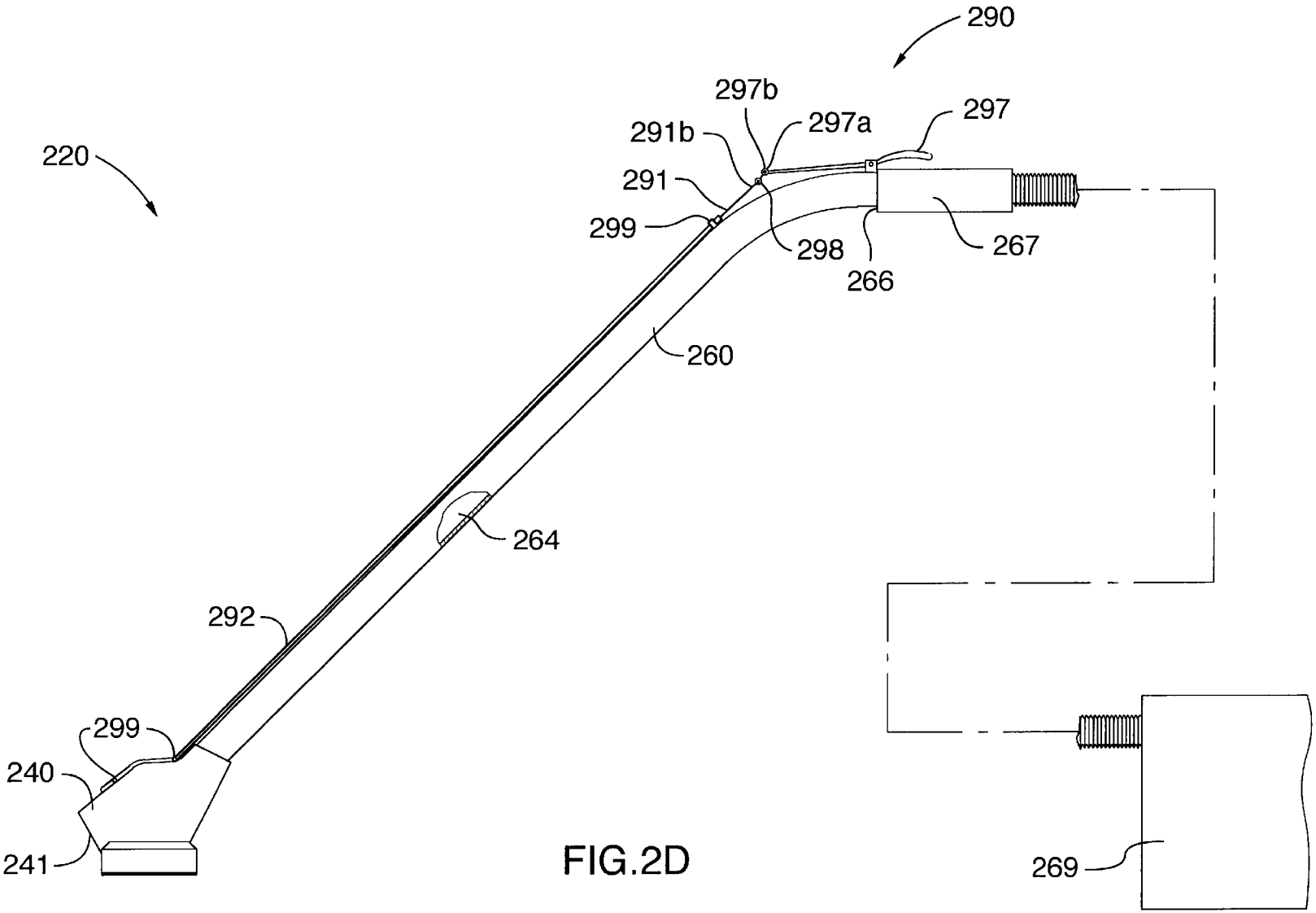
FIG. 2D is a reduced scale side elevational view of the second preferred embodiment large area surface cleaning tool of FIG. 2A.

As can be best seen in FIG. 2D, the selectively operable control means 290 also comprises a thumb operated lever 297 pivotally mounted onto the elongate wand 260 adjacent the outlet end 266 and adjacent the handle portion 267. The cable 291 is secured at its upper end 291*b* to one end 297*a* of the thumb operated lever 297 by passing through an aperture 297*b* and being secured back onto itself by means of a connector crimped 298 onto the upper end 291*b* of the cable 291. The cable is protected along most of its length by the sheath 292 that is secured to the elongate wand by a plurality of "U"-shaped connectors 299 threadibly fastened to the elongate wand 260 and to the first debris pick-up duct 240.

Reference will now be made to FIGS. 3A through 3D, which show a third preferred embodiment of the large area surface cleaning tool of the present invention, as indicated by general reference numeral 320. The large area surface cleaning tool 320 is similar to the second preferred embodiment large area surface cleaning tool 220, except that the first debris pick-up duct 340 is operatively mounted on the housing 330 and the elongate wand 360, for movement therewith, as the housing 330 is moved across the surface 322 being cleaned. In the third preferred embodiment as illustrated, the first debris pick-up duct 340 is partially integrally formed with the housing 330 and also forms a separate duct above the elongate wand 360. Alternatively, the first debris pick-up duct 340 may be operatively mounted on the elongate wand 360 so as to extend downwardly therefrom.

The debris outlet 342 is disposed in debris transfer relation at an airflow junction 343 with the airflow passageway 365 of the flexible suction hose 368, and with the vacuum source 369. The vacuum source 369 comprises both a source of vacuum and a debris receptacle, as is well known in the art.

Figure 3A:
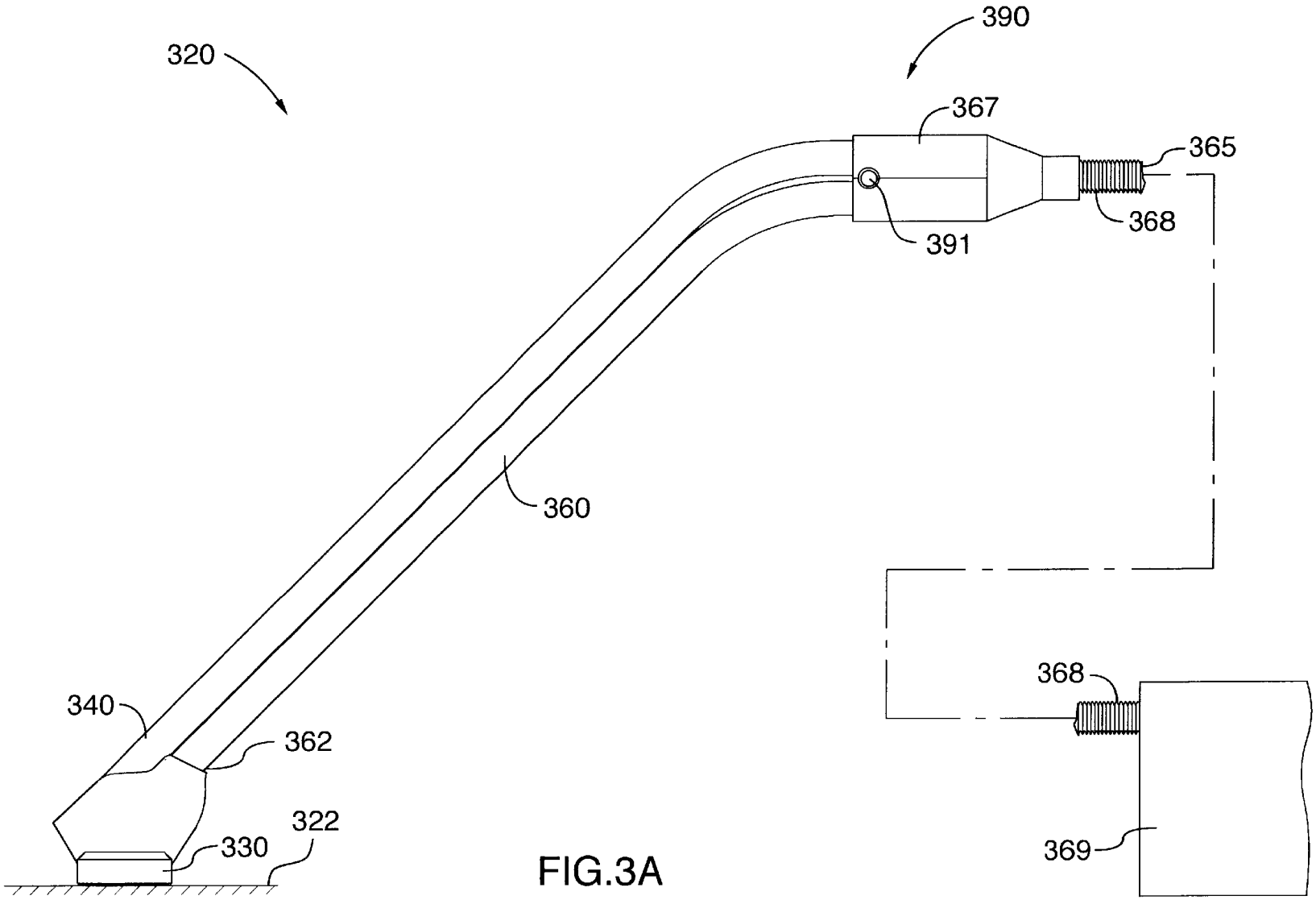
FIG. 3A is a reduced scale side elevational view of a third preferred embodiment of the large area surface cleaning tool according to the present invention.
Figure 3B:
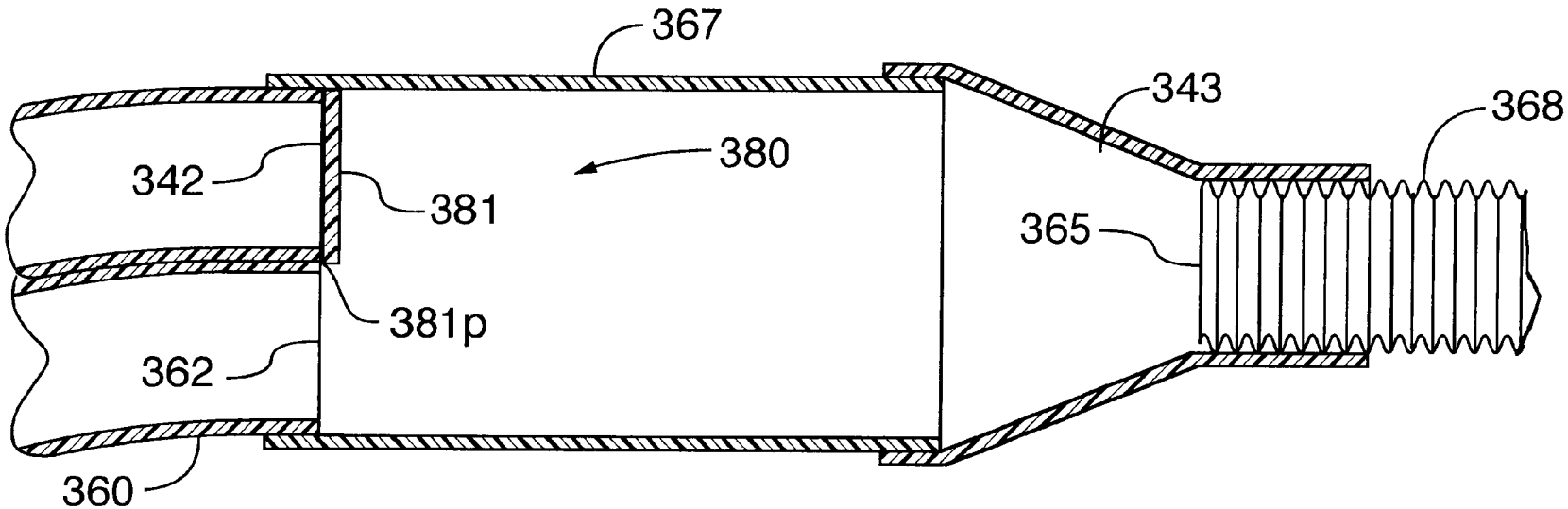
FIG. 3B is an enlarged side elevational view of a part of the third preferred embodiment large area surface cleaning tool of FIG. 3A, with a portion cut away, and with the flap valve in a first closed position.
Figure 3C:
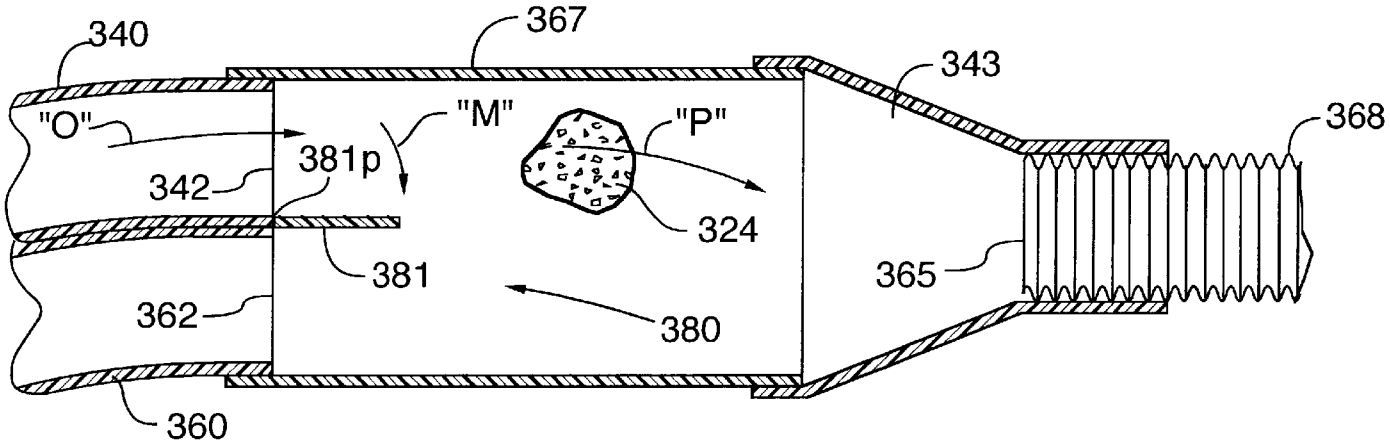
FIG. 3C is an enlarged side elevational view similar to FIG. 3B, but with the flap valve in an open position, and with debris transferring from the wand into the hose.
Figure 3D:
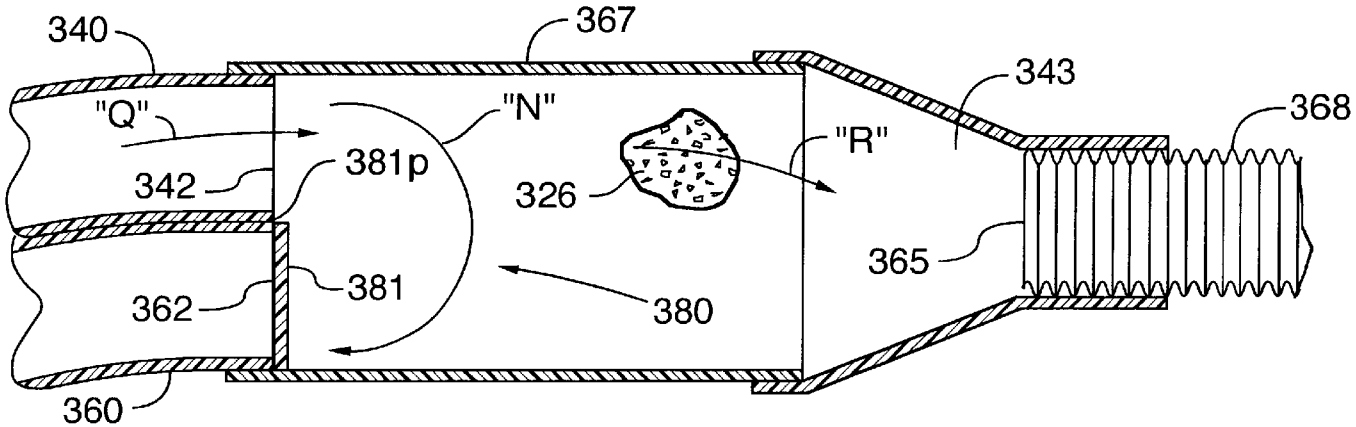
FIG. 3D is an enlarged side elevational view similar to FIG. 3B, but with the flap valve in a second closed position, and with debris transferring from the wand into the hose.

As can be seen in FIGS. 3B through 3D, the valve means 380 comprises a flap valve 381 pivotably mounted on a pivot axle 381*p* extending through apertures in the enlarged handle 367. The flap valve 381 is mounted for pivotal movement between a debris blocking position, as can be best seen in FIG. 3B, and a debris passage position, as can be best seen in FIGS. 3C and 3D.

As can be seen in FIG. 3A, the selectively operable control means 390 for controlling the valve means 380 comprises a rotary control knob 391 mounted on one end of the pivot axle 381*p* for moving the flap valve 381 between a debris blocking position, as can be seen in FIG. 3B, and debris passage positions, as indicated by arrow "M" in FIG. 3C and by arrow "N" in FIG. 3D. A detent mechanism (not shown) is used to retain the rotary control knob 391 in any selected angular position, and thus in any debris passage position or debris blocking position.

When the flap valve 381 is in the debris passage position as shown in FIG. 3C, debris 324 is suctioned through the first debris duct 340, as indicated by arrow "C", and into the airflow passageway 365 of the flexible suction hose 368, as indicated by arrow "P" to the vacuum source 369. Further, the inlet 362 of the elongate wand 360 remains in fluid communication with the vacuum source 369, thereby retaining dust suctioning capability by the housing 330.

When the flap valve 381 is in the debris passage position as shown in FIG. 3D, debris 326 is suctioned through the first debris duct 340, as indicated by arrow "Q", and into the airflow passageway 365 of the flexible suction hose 368, as indicated by arrow "R" to the vacuum source 369. Further, the inlet 362 of the elongate wand 360 is blocked from being in fluid communication with the vacuum source 369. Accordingly, the housing 330 loses its dust suctioning capability at this time.

Figure 4A:
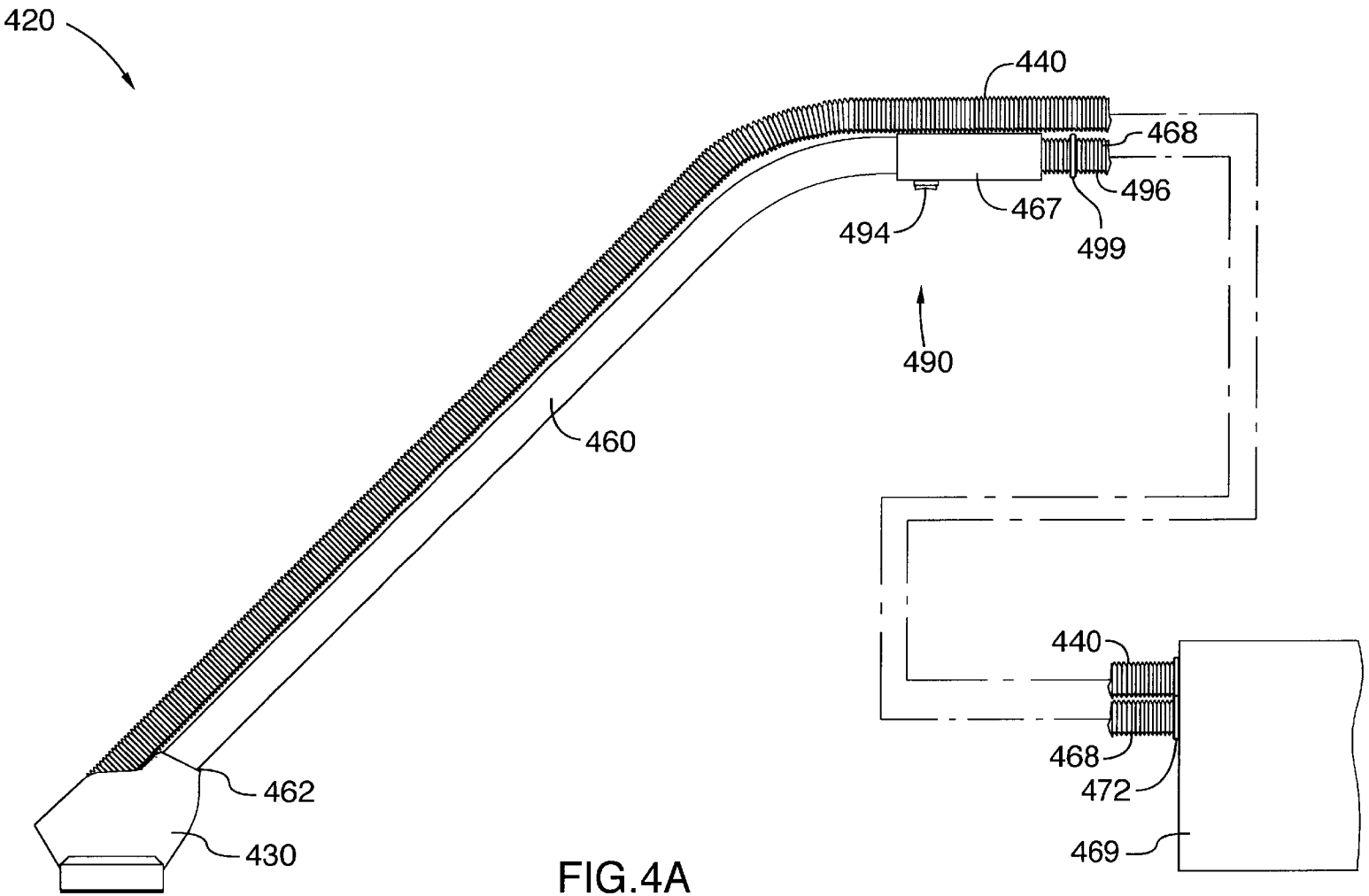
FIG. 4A is a reduced scale side elevational view of a fourth preferred embodiment of the large area surface cleaning tool according to the present invention.
Figure 4B:
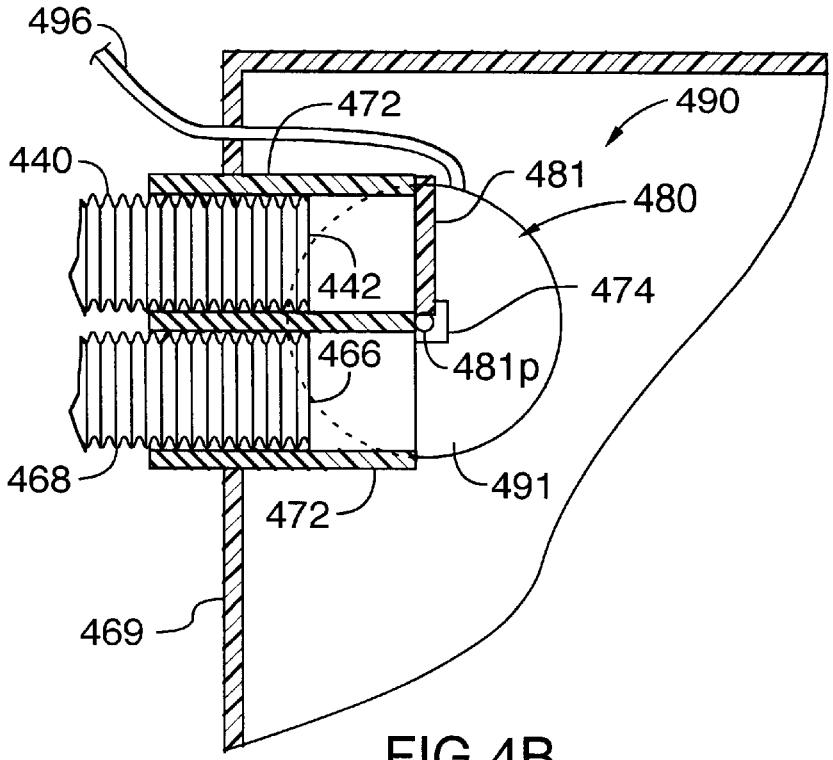
FIG. 4B is an enlarged side elevational view of a part of the fourth preferred embodiment large area surface cleaning tool of FIG. 4A, with a portion cut away, and with the flap valve in a first closed position.
Figure 4C:
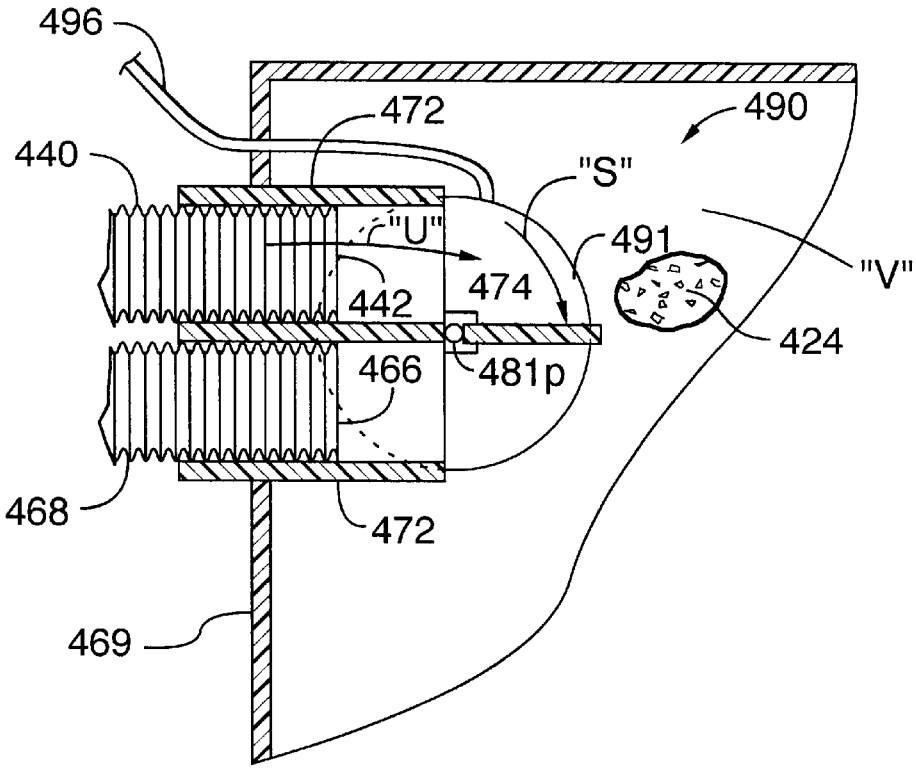
FIG. 4C is an enlarged side elevational view similar to FIG. 4B, but with the flap valve in an open position, and with debris entering into the vacuum source.
Figure 4D:
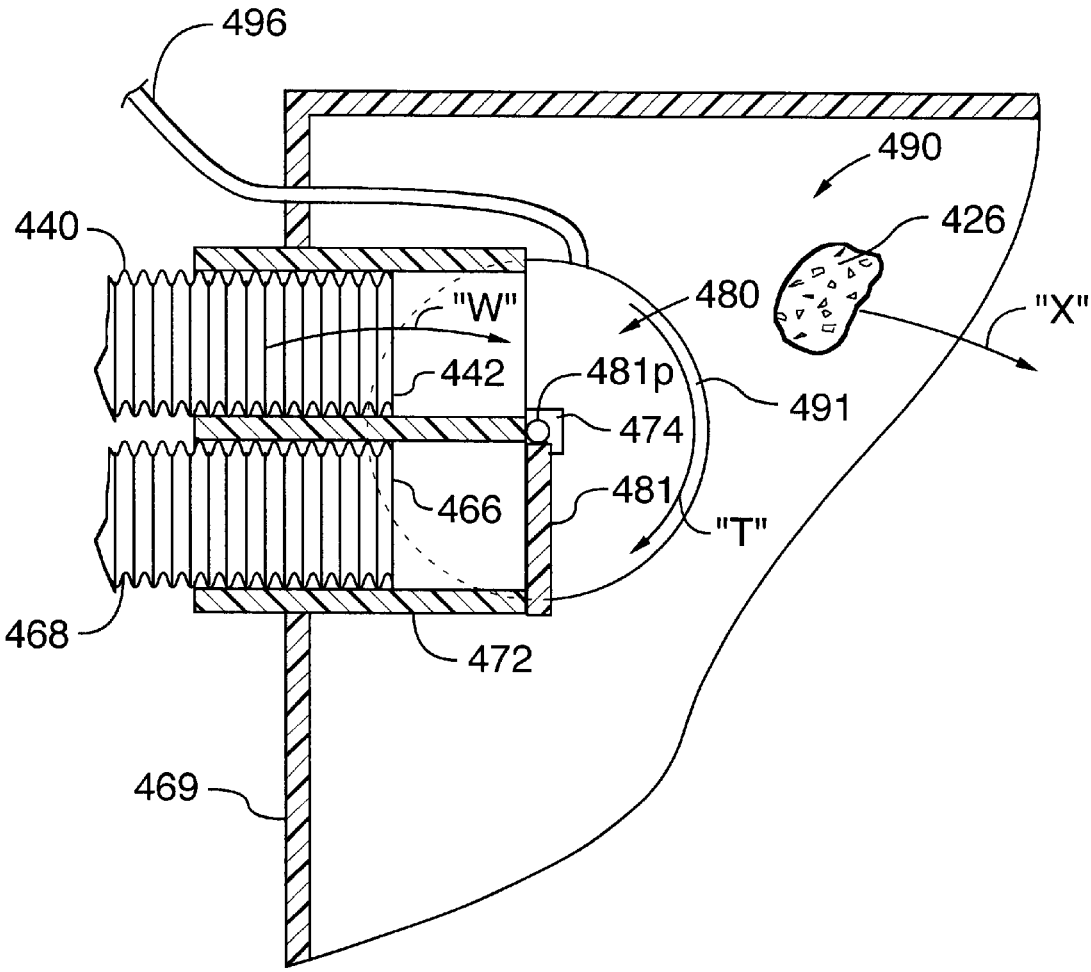
FIG. 4D is an enlarged side elevational view similar to FIG. 4C, but with the flap valve in a second closed position, and with debris entering into the vacuum source.
Figure 5A:
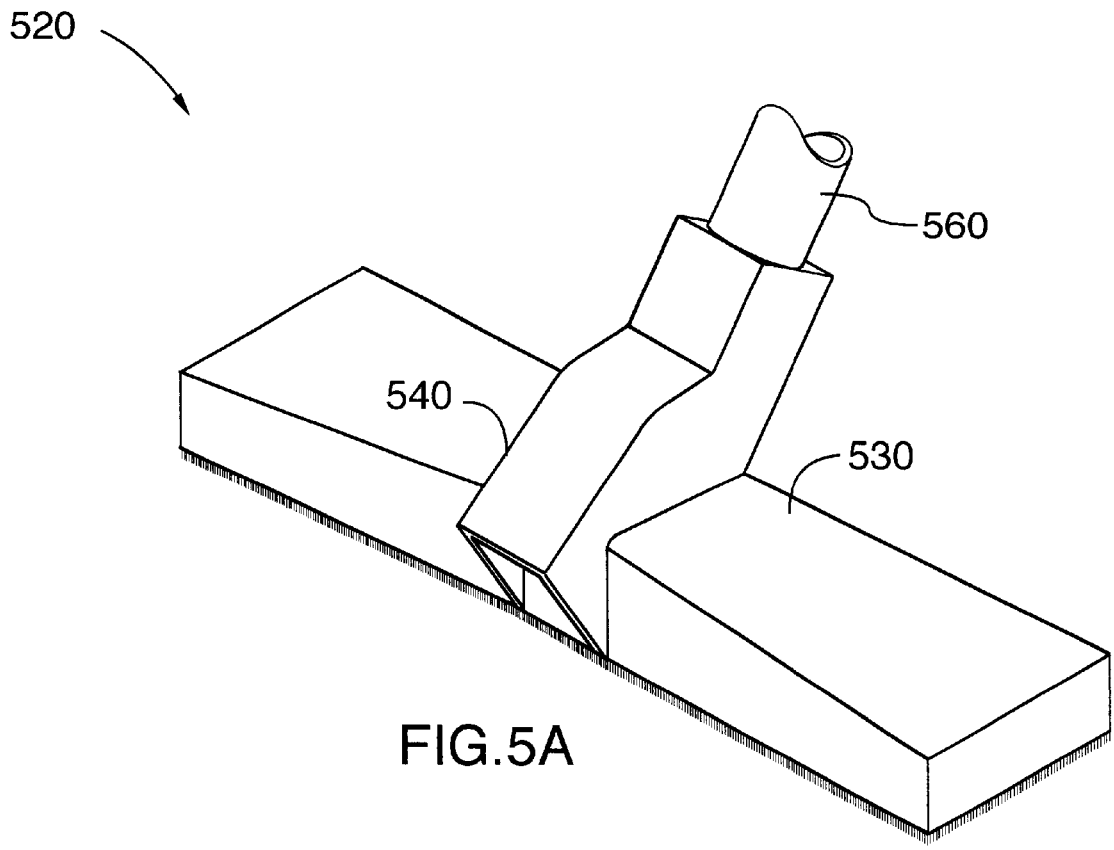
FIG. 5A is a perspective view of a fifth preferred embodiment of the large area surface cleaning tool according to the present invention.
Figure 5B:
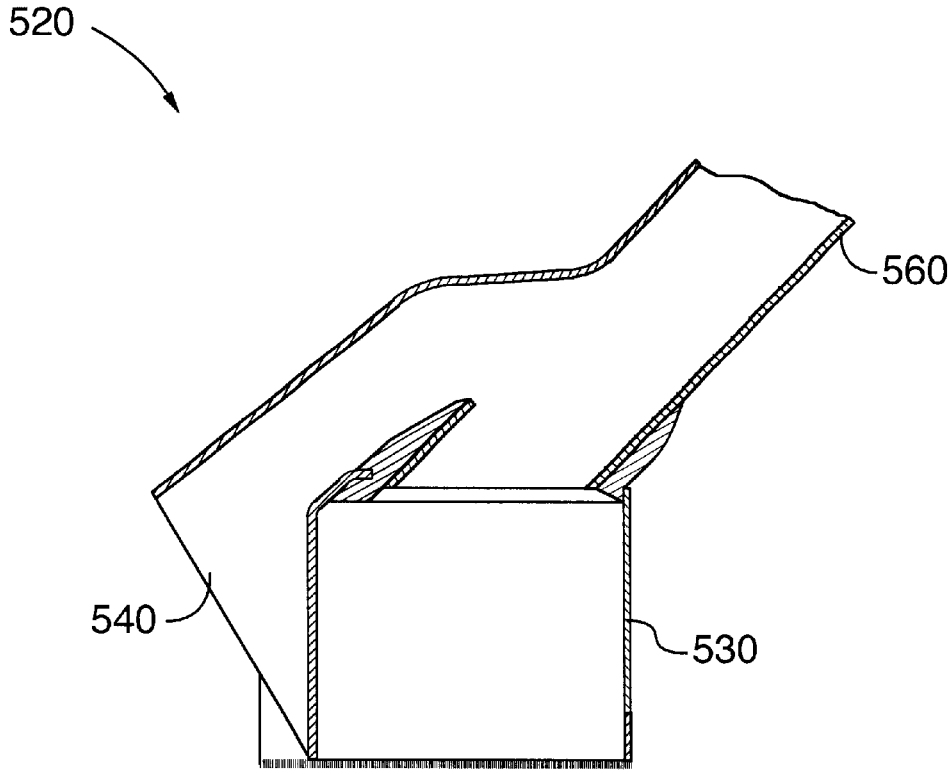
FIG. 5B is a cross-sectional side elevational view of the fifth preferred embodiment large area surface cleaning tool of FIG. 5A, taken along section line 5B—5B.
Figure 5C:
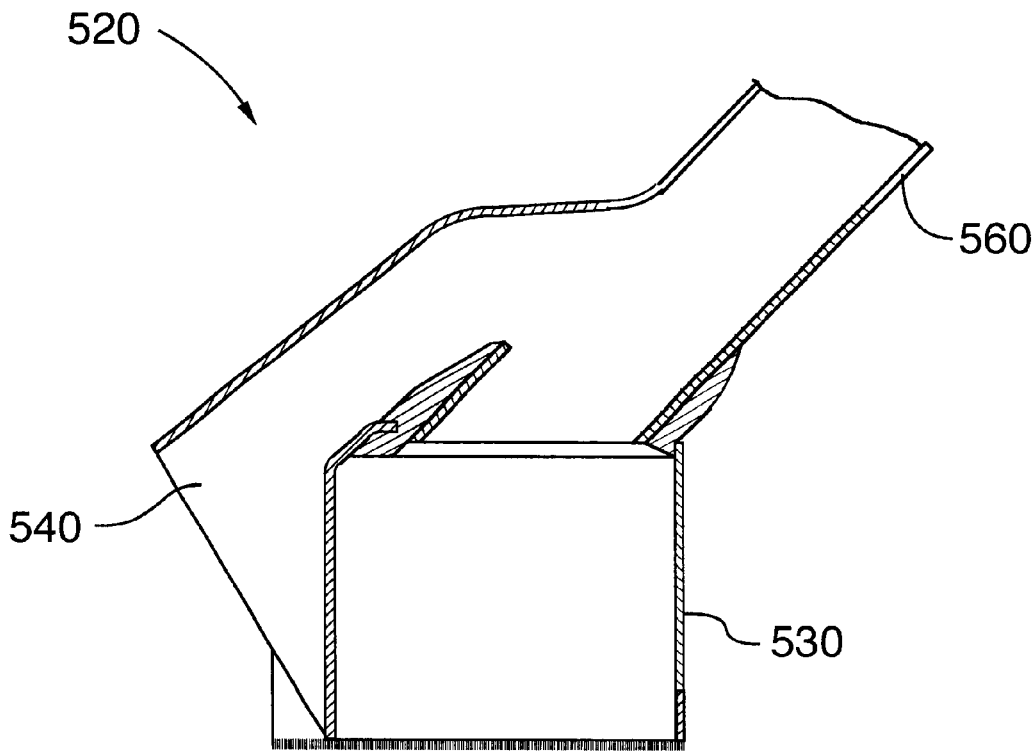
FIG. 5C is a cross-sectional side elevational view similar to FIG. 5B, but with debris entering into the first debris pick-up duct.
Figure 5D:
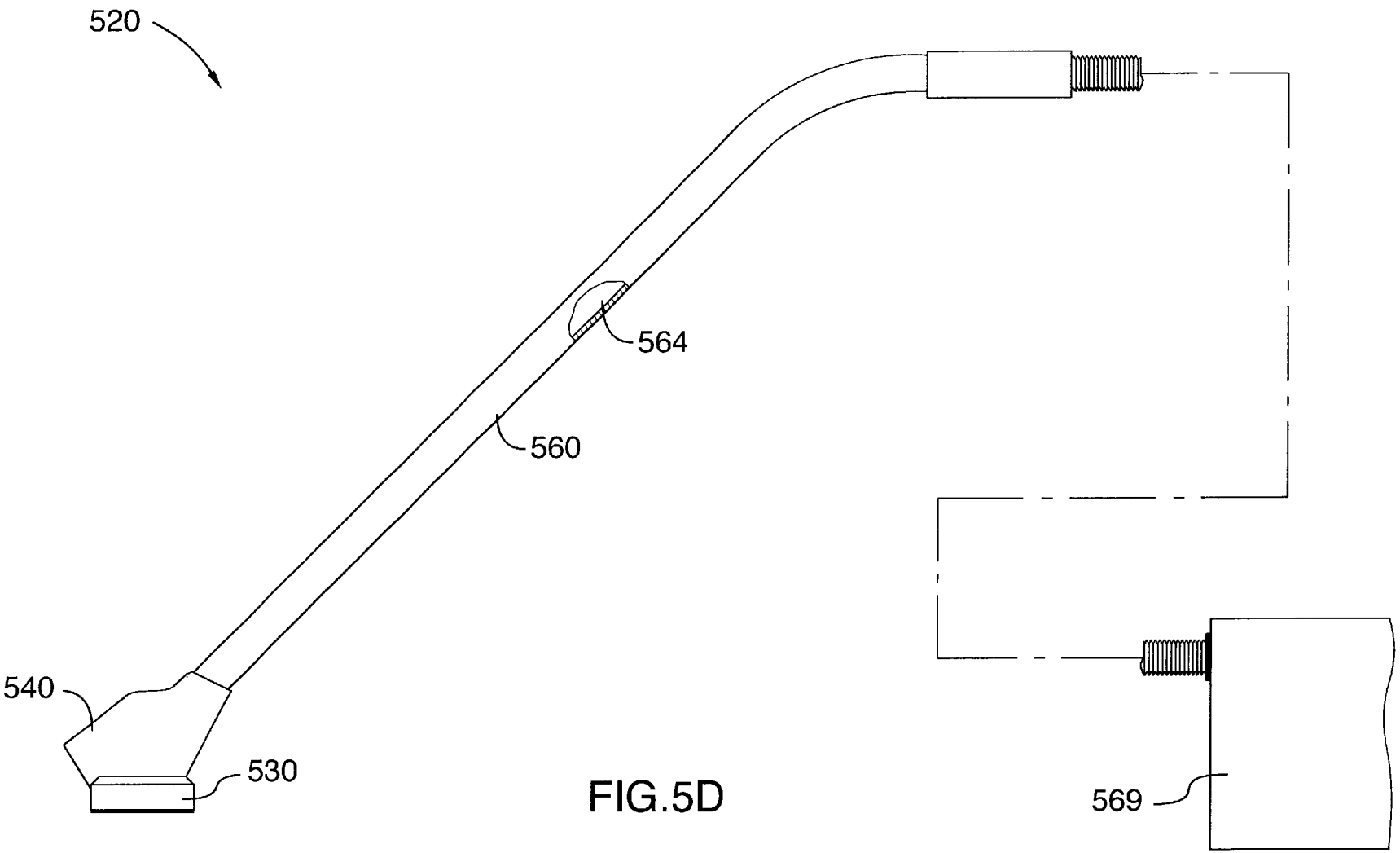
FIG. 5D is a reduced scale side elevational view of the fifth preferred embodiment large area surface cleaning tool of FIG. 5A.

Reference will now be made to FIGS. 4A through 4D, which show a fourth preferred embodiment of the large area surface cleaning tool of the present invention, as indicated by general reference numeral 420. The large area surface cleaning tool 420 is similar to the second preferred embodiment large area surface cleaning tool 220 and the third preferred embodiment large area surface cleaning tool 320, except that the debris outlet 442 of the first debris pick-up duct 440, which comprises a second flexible suction hose, is disposed in debris transfer relation directly with the vacuuming unit 469. The first flexible suction hose 468 and the second flexible suction hose 440 are each connected to the vacuuming unit 469 by a collar member 472, so as to each be in debris transfer relation to the vacuuming unit 469. As can be seen in FIGS. 4B through 4D, the valve means 480 comprises a flap valve 481 pivotably mounted on a pivot axle 481*p* extending through apertures (not shown) in mounting tabs 474 (only one shown) in the collar member 472. The selectively operable control means 490 for controlling the flap valve 481 comprises electrically operated rotary solenoid 491 is securely mounted to the vacuum source 469 via a bracket (not shown), so as to be disposed within the interior thereof, adjacent the outlet of both the first and second flexible suction hoses 468,440, for moving the flap valve 481 between a debris blocking position, as can be seen in FIG. 4B, and debris passage positions, as indicated by arrow "S" in FIG. 40 and as indicated by arrow "T" in FIG. 4D. The vacuum source 469 comprises both a source of vacuum and a debris receptacle, as is well known in the art.

When the flap valve 481 is in the debris passage position as shown in FIG. 4C, debris 424 is suctioned through the second flexible suction hose 440, as indicated by arrow "U", and into the vacuum source 469, as indicated by arrow "V". Further, the outlet 466, and therefore the inlet 462 of the elongate wand 460 remains in fluid communication with the vacuum source 469, thereby retaining dust suctioning capability by the housing 430.

When the flap valve 481 is in the debris passage position as shown in FIG. 4D, debris 426 is suctioned through the second flexible suction hose 440, as indicated by arrow "W", and into the vacuum source 469, as indicated by arrow "X". Further, the inlet 462 of the elongate wand 460 is blocked from being in fluid communication with the vacuum source 469. Accordingly, the housing 430 loses its dust suctioning capability at this time.

As can be seen in FIG. 4A, the selectively operable control means 490 for controlling the flap valve 481 also comprises a thumb operable momentary contact single-pole double-throw rocker switch 494 mounted onto the elongate wand 460 adjacent the handle portion 467, and electrically connected to the solenoid by a wire 496 secured to the first flexible suction hose 468 by a plurality of annular bands 499.

Reference will now be made to FIGS. 5A through 5D, which show a fifth preferred embodiment of the large area surface cleaning tool of the present invention, as indicated by general reference numeral 520. The large area surface cleaning tool 520 is similar to the second preferred embodiment large area surface cleaning tool 220 except that there is no valve means for controlling air and debris flow through the first debris pick-up duct 540. Instead, the air flow through the first debris pick-up duct 540 is determined by the capacity of the vacuum source 569 and by the relative size of the cross-sectional area of the first debris pick-up duct 540 and the internal airflow passageway 564 of the elongate wand 560. Accordingly, the suctioning of dust through the housing 530 and the suctioning of debris, and perhaps dust, through the first debris pick-up duct 540, both occur on a continuous basis, as caused by the vacuum source 569. The vacuum source 569 comprises both a source of vacuum and a debris receptacle, as is well known in the art.

As can be understood from the above description and from the accompanying drawings, the large area surface cleaning tool according to the present invention permits suctioning of both dust and debris from a surface without having to pick up the head and set it down onto debris; permits suctioning of both dust and debris from a surface while manipulating the tool with one hand; permits suctioning of both dust and debris from a surface without separating the tool from a suctioning hose; provides a cleaning tool that permits suctioning of dust and debris from a surface with increased efficiency and effectiveness, and provides a cleaning tool wherein debris does not need to be suctioned between the front and back portions of the perimeter wall, all of which features are unknown in the prior art.

Other variations of the above principles will be apparent to those who are knowledgeable in the field of the invention, and such variations are considered to be within the scope of the present invention. Further, other modifications and alterations may be used in the design and manufacture of the large area surface cleaning tool of the present invention without departing from the spirit and scope of the accompanying claims.

I claim:

1. A floor cleaning apparatus for suctioning both dust and debris from a surface being cleaned, said floor cleaning apparatus comprising:

a housing having a surface facing peripheral bottom edge defining a bottom plane, and having a suctioning bottom opening surrounded by said peripheral bottom edge, wherein, in use, said suctioning bottom opening is in dust suctioning relation to said surface being cleaned when said surface facing peripheral bottom edge is adjacent said surface being cleaned;

an elongate wand having an inlet disposed in dust and debris suctioning relation with respect to said suctioning bottom opening, and connected in fluid communication via an airflow passageway to an outlet disposed in dust and debris transfer relation with a vacuum source; and, a debris pick-up duct having a debris inlet situated adjacent to and at least partially above said bottom plane and exteriorly to said peripheral bottom edge of said housing, and a debris outlet in debris transfer relation with said vacuum source;

valve means mounted for operative engagement with said debris pick-up duct for movement between a dust suctioning configuration whereat substantially all of the airflow to said vacuum source passes through said suctioning bottom opening of said housing and a debris suctioning configuration whereat substantially all of the airflow to said vacuum source passes through said debris pick-up duct;

wherein, in use, said debris inlet is in debris receiving relation with respect to said surface being cleaned when said surface facing peripheral bottom edge of said housing is adjacent said surface being cleaned.

2. The floor cleaning apparatus of claim 1, further comprising a selectively operable control means for controlling said valve means.

3. The floor cleaning apparatus of claim 1, wherein said valve means comprises a diverter valve.

4. The floor cleaning apparatus of claim 1, wherein said valve means comprises a flap valve.

5. The floor cleaning apparatus of claim 1, wherein said housing has a perimeter portion having a front portion comprising left and right portions that are each sloped rearwardly and inwardly, and said debris inlet is disposed at said front portion between said left and right portions, in debris receiving relation with respect to said surface being cleaned.

6. The floor cleaning apparatus of claim 1, wherein said debris outlet of said debris pick-up duct is disposed in debris transfer relation at an airflow junction with said airflow passageway of said elongate wand.

7. The floor cleaning apparatus of claim 1, wherein said outlet of said elongate, wand is connected in dust and debris transfer relation to said vacuum source through a flexible suction hose having an airflow passageway.

8. The floor cleaning apparatus of claim 7, wherein said debris outlet of said debris pick-up duct is disposed in debris transfer relation at an airflow junction with said airflow passageway of said flexible suction hose.

9. The floor cleaning apparatus of claim 1, wherein said debris pick-up duct is mounted on said housing.

10. The floor cleaning apparatus of claim 1, wherein said debris pick-up duct is mounted on said elongate wand.

11. A floor cleaning apparatus for suctioning both dust and debris from a surface being cleaned, said floor cleaning apparatus comprising:

a housing having a surface facing peripheral bottom edge defining a bottom plane, and having a suctioning bottom opening surrounded by said peripheral bottom edge, wherein, in use, said suctioning bottom opening is in dust suctioning relation to said surface being cleaned when said surface facing peripheral bottom edge is adjacent said surface being cleaned;

an elongate wand having an inlet disposed in dust and debris suctioning relation with respect to said suctioning bottom opening and connected in fluid communication via an airflow passageway to an outlet in dust and debris transfer relation with a vacuum source; and, a debris pick-up duct having a debris inlet situated adjacent to and at least partially above said bottom plane and exteriorly to said peripheral bottom edge of said housing, and a debris outlet in debris transfer relation with said vacuum source;

valve means mounted for operative engagement with said debris pick-up duct for movement between a dust suctioning configuration whereat the majority of the airflow to said vacuum source passes through said suctioning bottom opening of said housing and a debris suctioning configuration whereat more airflow to said vacuum source passes through said debris pick-up duct than in said dust suctioning configuration, and wherein said valve means is biased to said dust suctioning configuration;

wherein, in use, said debris inlet is in debris receiving relation with respect to said surface being cleaned when said surface facing peripheral bottom edge of said housing is adjacent said surface being cleaned.

12. The floor cleaning apparatus of claim 11, further comprising a selectively operable control means for controlling said valve means.

13. The floor cleaning apparatus of claim 11, wherein said valve means comprises a diverter valve.

14. The floor cleaning apparatus of claim 11, wherein said valve means comprises a flap valve.

15. The floor cleaning apparatus of claim 11, wherein said housing has a perimeter portion having a front portion comprising left and right portions that are each sloped rearwardly and inwardly, and said debris inlet is disposed at said front portion between said left and right portions, in debris receiving relation with respect to said surface being cleaned.

16. The floor cleaning apparatus of claim 11, wherein said debris outlet of said debris pick-up duct is disposed in debris transfer relation at an airflow junction with said airflow passageway of said elongate wand.

17. The floor cleaning apparatus of claim 11, wherein said outlet of said elongate wand is connected in dust and debris transfer relation to said vacuum source through a flexible suction hose having an airflow passageway.

18. The floor cleaning apparatus of claim 17, wherein said debris outlet of said debris pick-up duct is disposed in debris transfer relation at an airflow junction with said airflow passageway of said flexible suction hose.

19. The floor cleaning apparatus of claim 11, wherein said debris pick-up duct is mounted on said housing.

20. The floor cleaning apparatus of claim 11, wherein said debris pick-up duct is mounted on said elongate wand.

21. A floor cleaning apparatus for suctioning both dust and debris from a surface being cleaned, said floor cleaning apparatus comprising;

a housing having a surface facing peripheral bottom edge defining a bottom plane, and having a suctioning bottom opening surrounded by said peripheral bottom edge, wherein, in use, said suctioning bottom opening is in dust suctioning relation to said surface being cleaned when said surface facing peripheral bottom edge is adjacent said surface being cleaned;

an elongate wand having an inlet disposed in dust and debris suctioning relation with respect to said suctioning bottom opening and connected via an airflow passageway having a general cross-sectional area to an outlet disposed in dust and debris transfer relation with a vacuum source; and, a debris pick-up duct having a debris inlet situated adjacent to and at least partially above said bottom plane and exteriorly to said peripheral bottom edge of said housing, and a debris outlet in debris transfer relation with said vacuum source, wherein said debris inlet has a cross-sectional area greater than one-third of said general cross-sectional area of said elongate wand;

wherein, in use, said debris inlet is in debris receiving relation with respect to said surface being cleaned when said surface facing peripheral bottom edge of said housing is adjacent said surface being cleaned, as aforesaid.

22. The floor cleaning apparatus of claim 21, wherein said debris inlet has a cross-sectional area greater than one-half of said general cross-sectional area of said elongate wand.

23. The floor cleaning apparatus of claim 21, wherein said housing has a perimeter portion having a front portion comprising left and right portions that are each sloped rearwardly and inwardly, and said debris inlet is disposed at said front portion between said left and right portions, in debris receiving relation with respect to said surface being cleaned.

24. The floor cleaning apparatus of claim 21, wherein said debris outlet of said debris pick-up duct is disposed in debris transfer relation at an airflow junction with said airflow passageway of said elongate wand.

25. The floor cleaning apparatus of claim 21, wherein said outlet of said elongate wand is connected in dust and debris transfer relation to said vacuum source through a flexible suction hose having an airflow passageway.

26. The floor cleaning apparatus of claim 25, wherein said debris outlet of said debris pick-up duct is disposed in debris transfer relation at an airflow junction with said airflow passageway of said flexible suction hose.

27. The floor cleaning apparatus of claim 21, wherein said debris pick-up duct is mounted on said housing.

28. The floor cleaning apparatus of claim 21, wherein said debris pick-up duct is mounted on said elongate wand.

* * * * *